United States Patent [19]

Hayden

[11] 4,003,011

[45] Jan. 11, 1977

[54] ELECTROMECHANICAL SWITCHING DEVICE

[75] Inventor: Rodney Hayden, Stoney Creek, Canada

[73] Assignee: TRW Inc., Cleveland, Ohio

[22] Filed: Sept. 4, 1975

[21] Appl. No.: 610,201

[30] Foreign Application Priority Data

June 18, 1975 Canada ..... 229651

[52] U.S. Cl. ..... 335/196; 335/131

[51] Int. Cl.[2] ..... H01H 1/12; H01H 51/06

[58] Field of Search ..... 335/196, 203, 202, 131

[56] References Cited

UNITED STATES PATENTS

| | | | |
|---|---|---|---|
| 3,217,124 | 11/1965 | Terry | 335/196 |
| 3,260,824 | 7/1966 | Schleicher | 335/196 |
| 3,378,798 | 4/1968 | Steiner | 335/203 |
| 3,418,609 | 12/1968 | Hayden | 335/203 |
| 3,559,132 | 1/1971 | Bernier | 335/203 |
| 3,573,689 | 4/1971 | Hayden | 335/196 |

*Primary Examiner*—Harold Broome
*Attorney, Agent, or Firm*—James R. O'Connor

[57] ABSTRACT

In a relay construction, an insulate coil form having a through bore and a coil wound thereon is fixed to an insulate base by a fixed core part which straddles the coil form and is fastened to the base. The fixed core part has an opening aligned with the bore in the coil form and a plunger or movable core part is mounted for linear reciprocating travel in said opening and bore. An armature in the form of an obturator-type strip of spring metal has one end fastened to the base beneath the coil form and extends outwardly and upwardly from the base in a continuous arcuate bend to its other end which lies above the fixed core part and is fastened to the upper end of the plunger. The obturator strip carries a contact proximate the apex of its bend which tangentially engages a fixed contact leading to an output terminal when the relay coil is energized to magnetize the fixed core part and thereby cause the plunger to move downwardly further into the bore in the coil form.

12 Claims, 7 Drawing Figures

ELECTROMECHANICAL SWITCHING DEVICE

BACKGROUND OF THE INVENTION

The invention relates generally to electromechanical switching devices, particularly relays, and, more particularly, to a quiet, direct current relay for automotive use.

In recent years there have been numerous attempts by a number of manufacturers to provide a relay for automotive use which does not generate appreciable audible sound when actuated. While, on the one hand, it may be desirable for a relay actuating direction signal device to generate a click or other conscious sound so that the driver will be aware that the signal is actually operating, it is also a general requirement, heretofore unmet, that a large number of other relays in electrical circuitry of an automobile emit negligible sound when activated. As of the present date, a fully electrically equipped automobile may contain in its electrical circuitry up to thirty or more relays. Considering the variety of conditions which actuate such circuitry, the sounds of relay actuation responsive to such conditions can generate a chorus of nerve-racking, orchestrated sound. Thus, the object of this invention is to provide a relay structure which relative to the sensitivity of the human ear is of substantially noiseless character at relatively close distances and which, by virtue of its construction, avoids, when energized, the collision of masses moving in a path or direction line of force which would generate considerable noise and/or precipitate vibration in a support for the relay structure. Additional advantages to be derived from the improved relay construction will become evident from a reading of the detailed specification which follows in conjunction with a viewing of the accompanying drawing.

SUMMARY OF THE INVENTION

A relay comprising: an insulate base; an insulate coil form having a longitudinal bore formed therein mounted on said base; a coil wound on said coil form; a fixed core part mounted on said base, said fixed core part having an opening which is registered with the bore in said coil form and said fixed core part being magnetizable responsive to energization of said coil; a movable core part slidably seated in said opening in said fixed core part and said bore in said coil form; an armature carrying a first contact means, said armature being in the form of a spring metal strip having one end fixed to said base adjacent said coil form and another end joined to said movable core part; and a second contact means connected to said base and extending upwardly therefrom, said first contact means being substantially tangentially engageable with said second contact means upon movement of said movable core part in said bore in said coil form responsive to energization of said coil and consequent magnetization of said fixed core part.

DESCRIPTION OF A PREFERRED EMBODIMENT

Figure 1:
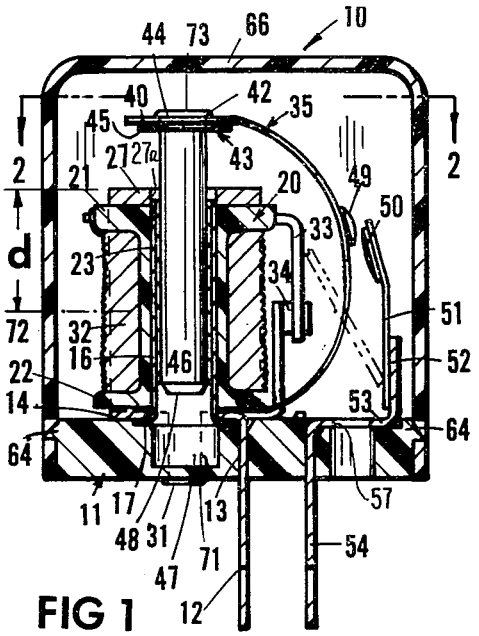
FIG. 1 is a sectional elevation of the relay structure of the invention.
Figure 7:
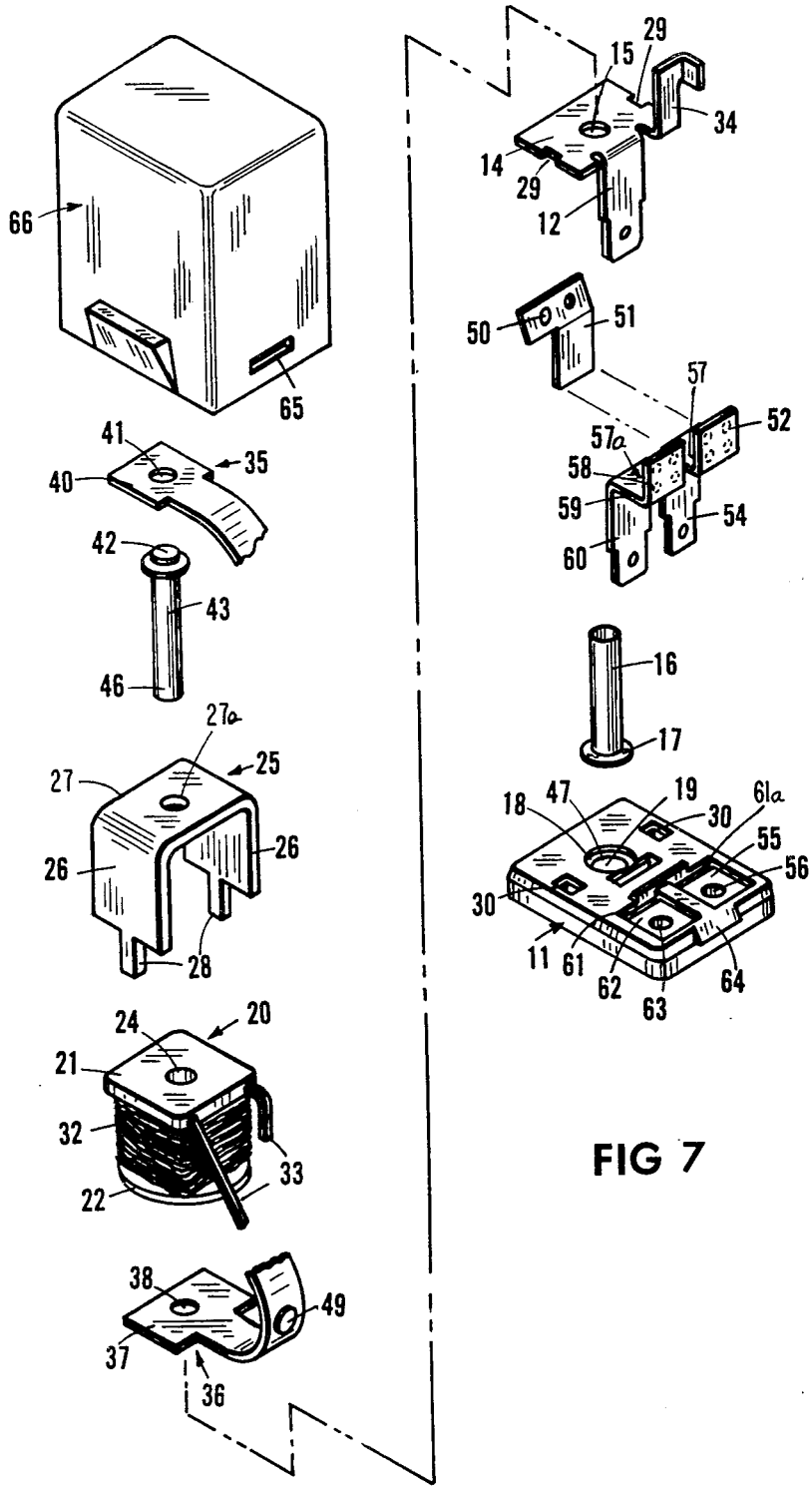
FIG. 7 is a vertically exploded view of the components of the relay of the invention.

As seen in FIGS. 1 and 7, the insulate base 11 of the relay 10 has formed therethrough a slot 13 through which terminal member 12 extends. The terminal member 12 includes a coil form supporting flange 14 having an opening 15 therein. Upstanding plunger receiving tube 16 having an annular flange 17 at the lower end thereof extends upwardly through the opening 15 of the terminal member 12 in such a manner that flange 17 is seated in a countersunk recess 18 located above a hole 19 in the base, the latter hole being axially registered with the hole 15 in terminal member 12.

Insulate coil form 20 has upper and lower flanges 21, 22 which are joined by a tubular spool body 23 having a bore 24 formed therethrough and plunger tube 16 is seated in said bore in the spool body. Terminal member 12 is preferably formed of a ferrous metal whereas the tube 16 is nonmagnetic. A fixed core part 25 formed from a ferrous metal stamping of predetermined thickness is of inverted U-shaped configuration and includes two legs 26 extending downwardly from the ends of an intermediate web 27. The core part 25 straddles the coil form 20 such that web 27 is biased against flange 21 and the legs 26 extend downwardly on opposite sides of the coil form. The free ends of the legs carry tabs 28 which seat in notches 29 of flange 14 of the terminal member 12 and pass through openings 30 in base 11 and are swaged as at 31 over the undersurface of base 11 thereby to fasten the coil form 20, tube 16, and terminal member 12 to the base.

Coil form spool body 23 has a coil 32 wound thereon and the ends of the coil winding are connected to rigid connector rods 33 seated in the upper flange 21 of the coil form. The rods 33 extend through the flange 21 and outwardly thereof and are bent to the extent required to weld or solder the rods to a desired connection, such as to connection rim 34 of terminal 12.

Figure 5:
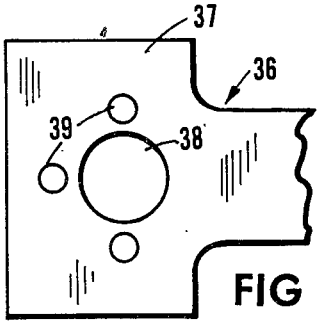
FIG. 5 is a detail of the anchorage end of the obturator member.
Figure 6:
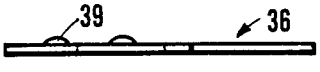
FIG. 6 is a side elevation of the portion of the obturator depicted in FIG. 5.

An armature in the form of an arcuate obturator 35, which is formed from a strip of spring metal, has a lower end 36 including flanges 37 which is anchored between the lower flange 22 of the coil form 20 and the support flange 14 of terminal member 12. Tube 16 passes through a hole 38 formed through the lower end or mounting base part 36 of the obturator. Obturator mounting base part 36 which is shown in enlarged detail in FIGS. 5 and 6 carries bosses 39 which are adapted to be slightly crushed upon fastening of the coil form 20, terminal member 12, and mounting base part 36 to the base 11 by the core part 25 to inhibit accidental working loose of the components of the assembly described over a period of continued usage of the relay. The upper end 40 of the obturator 35 opposite the anchored end 36 has an opening 41 through which the head portion 42 of an actuating plunger or piston extends initially and is thereafter peened over to provide a rivet head 44 holding the end 40 of the obturator rigidly in assembly against a head flange 45 on the plunger 43. The plunger 43 passes through an opening 27*a* in the web 27 of the core part 25 and is slidably seated within the tube 16 positioned in bore 24 of coil form 20. Accordingly, when current is applied to coil 32, core form part 25 is magnetized and plunger 43 is drawn downwardly into coil form 20 causing the lower end 46 of the plunger to descend into the recess 47 (see FIG. 7) of base 11. The recess 47 is of sufficient depth to provide a clearance space with the bottom face 48 of the plunger 43 at the lowermost position thereof. Upon the deenergizing of coil 32, the plunger and obturator spring return to the free support position depicted in FIG. 1.

Figure 2:
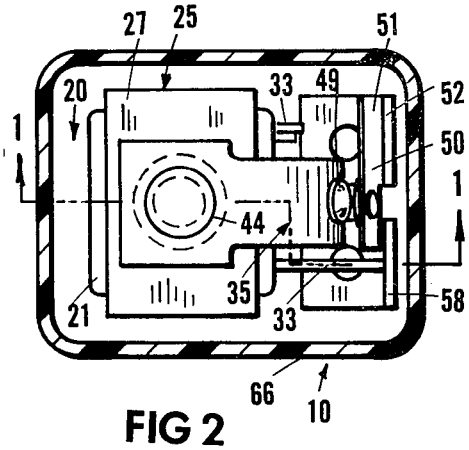
FIG. 2 is a plan section taken on line 2—2 of FIG. 1.

Obturator spring 35 carries a contact 49 rigidly fastened thereto such as by welding or riveting according to well-known techniques. As seen in FIG. 1, contact 49 is obliquely spaced from a contact 50 mounted on a spring arm 51 which is joined to and extends upwardly from a mounting flange 52 rising from a base flange 53 of an output terminal member 54 which extends through a slot 61*a* in base 11. The base flange 53 of the output terminal is secured in a recess 55 of base 11 by a rivet (not shown) which passes through an opening 56 in base 11 and a base flange hole 57. The other rigid connecting rod 33, as seen in FIG. 2, is connected to a flange 58 upstanding from a base flange 59 of a terminal member 60. The terminal member 60 passes through a slot 61 in base 11 such that base flange 59 seats in a recess 62 in base 11 and is fastened therein by a suitable rivet (not shown) passing through a hole 63 in base 11 and an opening 57*a* in base flange 59.

The base 11 also carries protuberances 64 at both ends thereof which are adapted to seat in transverse openings 65 of a casing or housing envelope 66.

Figure 4:
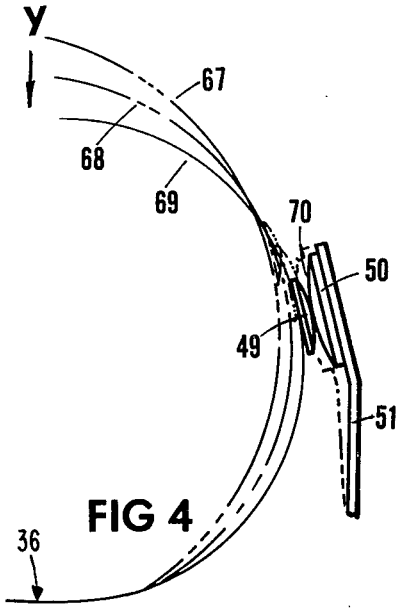
FIG. 4 is a diagrammatic illustration of the wiping, sliding action of the contacts of the relay of the invention.

FIG. 4 illustrates the sliding, noiseless engagement between the contacts 49 and 50 when the relay is energized and plunger 43 descends in the direction of arrow Y from the free support position of FIG. 1 toward the fixed end 36 of the obturator. The free or preenergization position of the armature-obturator 35 is illustrated by the triple chain line 67. When the relay is energized and plunger 43 begins to descend, the armature-obturator first moves through the position illustrated by double chain line 68. At said position, contact 49 slidably, lightly touches contact 50 with arm 51 disposed in the normal, phantom line position indicated. Thereafter, as plunger 43 continues to descend to its final energized position, i.e., when its lower end 46 is seated in recess 47, indicated by full line 69, contact 49 slidingly rides over the surface 70 of the contact 50 thereby deflecting the contact arm 51 to the bold line position indicated. One will readily appreciate that the angle of sliding contact is substantially tangential as between the path of motion of the contact 49 and the surface 70 of the contact 50 as a result of which contact is made in such a manner as to generate negligible audible sound. Neither the plunger head flange 45 nor the bottom face 48 of the plunger will come into contact with the core part web 27 or the base recess face 71, respectively, because face 71 is positioned more than one-half the length of plunger 43 from the middle line 72 of coil 32 and because the length of the plunger between the bottom face 48 thereof and the upper end 73 thereof is greater than the distance "*d*" from the middle line of the coil to the top face of the web 27 of the core part 25.

Figure 3:
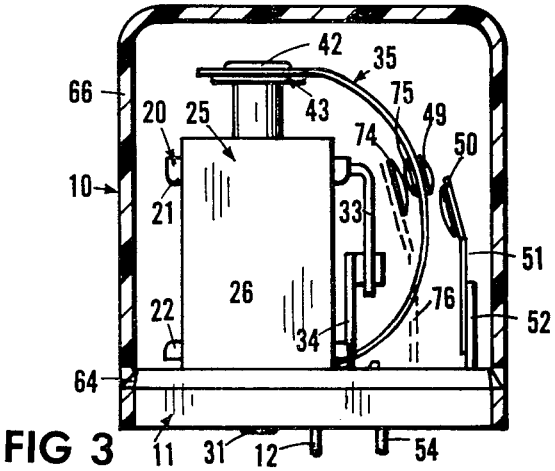
FIG. 3 is a side elevation showing the housing in section of a modified form of the relay of the invention.

As seen in FIG. 3, the relay of the invention may embody a normally closed contact member 74 adapted to articulate with an inner movable contact member 75 on obturator spring arm 35, said normally closed contact being mounted on a spring arm 76 shown in chain lines and connected to a suitable terminal member (not shown) extending through base 11 in a manner similar to terminal members 54 and 60.

The plunger 43 slidably fits within plunger tube 16 and may be lubricated in its sliding action by a suitable lubricant having a low change in viscosity over a wide temperature range. A viscosity DN number in a range of 150,000 to 200,000 over a temperature range of −100° F to +375° F is particularly useful. The viscosity of the lubricant has some degree of damping action which may or may not be desired depending upon the specific use of the relay of the invention. It is desirable when employing a lubricant for the plunger to provide a breathing hole in the face 71 of the recess 47 or to provide other means for the escape of air.

I claim:

1. An electromechanical switching device comprising: an insulate base; an input terminal connected to said base; a device actuating means; device actuating means mounting means associated with said base, said mounting means supporting said device actuating means for linear reciprocating movement relative thereto; an arcuately bent armature, said armature being electrically connected to said input terminal and being in the form of a spring metal strip, one end of said armature strip being fixed to said base and the other end of said strip being connected to said device actuating means; a first contact means carried by said armature strip between said ends and relatively proximate the apex of the bend thereof; an output terminal joined to said base; and a second contact means associated with said base and electrically connected to said output terminal; said first contact means being tangentially engageable with said second contact means responsive to movement of said device actuating means relative to said mounting means.

2. An electromechanical switching device comprising: an insulate base; an input terminal connected to said base; a plunger; plunger mounting means associated with said base, said mounting means supporting said plunger for linear reciprocating movement relative thereto; an arcuately bent armature, said armature being electrically connected to said input terminal and being in the form of a spring metal strip, one end of said armature strip being fixed to said base and the other end of said strip being connected to said plunger; a first contact means carried by said armature strip between said ends and relatively proximate the apex of the bend thereof; an output terminal joined to said base; and a second contact means associated with said base and electrically connected to said output terminal; said first contact means being obliquely spaced from said second contact means and being tangentially engageable with said second contact means responsive to movement of said plunger relative to said mounting means.

3. A relay comprising: an insulate base; an insulate coil form having a longitudinal bore formed therein mounted on said base; a coil wound on said coil form; a fixed core part mounted on said base, said fixed core part having an opening which is registered with the bore in said coil form and said fixed core part being magnetizable responsive to energization of said coil; a movable core part slidably seated in said opening in said fixed core part and said bore in said coil form; an armature carrying a first contact means, said armature being in the form of a spring metal strip having one end fixed to said base adjacent said coil and another end joined to said movable core part; and a second contact means connected to said base and extending upwardly therefrom, said first contact means being obliquely spaced from said second contact means and being substantially tangentially engageable with said second contact means upon movement of said movable core part in said bore in said coil form responsive to energization of said coil and consequent magnetization of said fixed core part.

4. A relay according to claim 3 wherein said fixed core part is a ferrous metal stamping of a predetermined thickness which is of generally inverted U-shape and includes a transverse web which is biased against said coil form and at least a pair of opposed legs extending from said web alongside said coil form, said legs being anchored to said base to rigidly attach said coil form thereto.

5. A quiet relay comprising: an insulate base; an insulate coil form standing on said base, said coil form having a central bore formed therein; a relay coil wound on said coil form; a fixed core part, said fixed core part being in the form of an inverted U-shaped stamping of a predetermined thickness of ferrous metal having a transverse web extending between opposed longitudinal legs, said web having an aperture formed therethrough, said core part being fitted over said coil form such that said aperture is registered with the bore in said coil form and said legs being fastened to said base to rigidly fix said coil form and said coil to said base; an armature in the form of an arcuate obturator formed from a strip of spring metal having one end anchored between said coil form and said base and extending outwardly and arcuately upwardly from said base to its opposite end which is disposed above said web of said fixed core part; a movable core part in the form of a plunger slidably mounted in said bore in said coil form and said opening in said web, said opposite end of said obturator strip being connected to said movable core part; a contact terminal rising from said base to present a contact element to said obturator strip between said one end and said opposite end thereof; and a contact region on said obturator strip substantially tangentially engageable with said contact element responsive to sliding movement of said movable core part relative to said coil form and said fixed core part.

6. A quiet relay according to claim 5 wherein the length of the plunger forming said movable core part is greater than the axial length of said coil form plus the metal thickness of the web of said fixed core part.

7. A quiet relay according to claim 5 wherein said one end of said obturator strip includes an enlarged mounting base having a plurality of bosses formed therein.

8. A quiet relay according to claim 5 wherein at least one rigid rod connector is mounted in said coil form and one end of said coil is connected thereto, and a terminal for said relay which extends through said base is also connected to said rod connector.

9. A quiet relay according to claim 5 wherein said base has a recess formed therein which is aligned with said bore in said coil form and is adapted to freely receive one end of said plunger when said relay is energized.

10. A quiet relay according to claim 9 wherein the bottom face of said recess is axially spaced from the midline of the axial length of said coil by a predetermined distance which is greater than one-half the overall length of said plunger.

11. A quiet relay according to claim 5 including third contact means carried by said obturator strip on the side thereof opposite said second contact means; and fourth contact means associated with said base, said third contact means being adapted to articulate with said fourth contact means responsive to movement of said plunger; said third and fourth contact means being obliquely oriented relative to one another to provide for substantially tangential engagement thereof.

12. An electromechanical switching device including an input terminal, an output terminal, a stationary contact connected to said output terminal, an obturator, said obturator being in the form of a flexible metallic strip having stationary and movable mounting end portions and an unsupported section between said end portions, said stationary end portion being connected to said input terminal at a fixed anchorage and said movable end portion being connected to a movable anchorage which is movable in a line of direction toward said fixed anchorage, said unsupported section having a length greater than the distance between said fixed anchorage and said movable anchorage and said unsupported section traversing a continuous arcuate bend between said stationary and movable end portions, and a movable contact disposed on said obturator proximate the midpoint of the bend in said unsupported section and substantially remote from said stationary and movable end portions, said movable contact being movable along a line of direction which is substantially tangent to the curve of the bend in said unsupported section at its apex to cause said movable contact to tangentially engage said stationary contact responsive to movement of said movable end portion of said obturator toward said stationary end portion thereof.

* * * * *